US005513586A

United States Patent [19]

Neely et al.

[11] Patent Number: 5,513,586

[45] Date of Patent: May 7, 1996

[54] BELT DRIVEN LOOPER DRIVE

[75] Inventors: Marshall A. Neely, Hixson; Paul E. Beatty, Chattanooga both of Tenn.

[73] Assignee: Card-Monroe Corp., Chattanooga, Tenn.

[21] Appl. No.: 155,992

[22] Filed: Nov. 22, 1993

[51] Int. Cl.[6] ..... D05C 15/22

[52] U.S. Cl. ..... 112/80.01; 112/220; 112/475.23

[58] Field of Search ..... 112/80.01, 80.5, 112/220, 199, 475.23; 74/89.2, 89.21, 89.22, 89

[56] References Cited

U.S. PATENT DOCUMENTS

| | | | |
|---|---|---|---|
| 3,361,096 | 1/1968 | Watkins | 112/80.5 X |
| 4,419,944 | 12/1983 | Passons et al. | 112/80.5 X |
| 4,586,845 | 5/1986 | Card et al. . | |
| 4,665,845 | 5/1987 | Card et al. . | |

FOREIGN PATENT DOCUMENTS

| | | |
|---|---|---|
| 699657 | 11/1953 | United Kingdom . |
| 1098219 | 1/1968 | United Kingdom . |
| 1304151 | 1/1973 | United Kingdom . |
| 1507201 | 4/1987 | United Kingdom . |
| 2181163 | 4/1987 | United Kingdom . |

*Primary Examiner*—Paul C. Lewis
*Attorney, Agent, or Firm*—Hopkins & Thomas

[57] ABSTRACT

A tufting machine has a main drive shaft, a looper shaft and parallel to the main shaft, a drive train therebetween in which a spindle supports, on its end, a sprocket which is driven by an endless belt from a wheel on the drive shaft. The other face of the sprocket carries a stroke control lug provided with a orbital crank pin which reciprocates a link connected to a lever on the looper shaft thereby for rocking the looper shaft, rocking the loopers carried by the looper shaft.

24 Claims, 4 Drawing Sheets

BELT DRIVEN LOOPER DRIVE

FIELD OF INVENTION

This invention relates to a tufting machine and is more particularly concerned with a looper drive system for a tufting machine.

BACKGROUND OF THE INVENTION

In the past, belts have been utilized as part of the drive train for driving the needle bars of tufting machines from the main drive shaft. Examples of such drive systems which utilize belts are found in U.S. Pat. No. 4,665,845 and U.S. Pat. No. 4,586,445. Such tufting machines, however, have had conventional looper drive systems which employ eccentric cams which drive straps for reciprocating the loopers. Such straps are quite heavy and have materially contributed to the unbalancing of the tufting machine. Such straps are infinitely adjustable and, therefore are difficult to adjust by the same amounts so that the straps at both ends of a looper shaft apply equal torque.

SUMMARY OF THE INVENTION

Briefly described, the present invention includes a conventional tufting machine having a main drive shaft which supplies power for reciprocating the needle bar and the loopers. This machine has a conventional looper shaft which is disposed below the main drive shaft in parallel relationship thereto. The looper shaft is journaled at its end portions by pillow blocks and has power trains from the main drive shafts, each of which has a freely rotatable spindle disposed above and parallel to the looper shaft. Each drive train includes a flexible, endless, timing belt, which extends around a pulley or sheave on the main drive shaft and encompasses a sprocket on the end of the spindle so that the sprocket drives the stub shaft in synchronized, timed relationship to the rotation of the main drive shaft at a position closely adjacent to the looper shaft. A concentrically mounted, stroke control lug removably fits onto the radially disposed outer face of the sprocket, and has an eccentrically mounted drive pin which protrudes outwardly from the lug so as to travel in an orbital path when the sprocket is rotated. This drive pin is removably received in a bearing at one end of a short, rigid, link, the other end of which is pivotally connected to the distal end of a looper drive lever which protrudes radially from the looper shaft. Thus, as the sprocket is rotated, the link will be moved upwardly and downwardly for imparting a reciprocal or rocking motion to the looper drive shaft. Such a construction is inexpensive, weighing about one-eighth of the weight of the conventional train so that it creates little vibration at high speed. The lugs are readily changeable to alter the stroke and timing of the loopers.

Accordingly, it is an object of the present invention to provide a tufting machine having a looper assembly which substantially reduces the weight of the drive train for rocking the looper shaft.

Another object of the present invention is to provide, in a tufting machine, a drive train which will increase the speed at which the tufting machine may be operated.

Another object of the present invention is to provide a tufting machine in which the amount of heat and friction required for rocking a looper shaft and loopers is reduced to a minimum.

Another object of the present invention is to provide a tufting machine in which the drive train for the looper shaft can be readily and easily re-timed and the stroke of loopers readily and easily altered.

Another object of the present invention is to provide a tufting machine having a drive train for the looper shaft which reduces the vibration of the machine.

Another object of the present invention is to provide a tufting machine in which the drive train for the looper shaft can be readily and easily repaired.

Another object of the present invention is to provide a tufting machine in which the looper stroke can be readily and accurately changed and which will provide more positive adjustment of the timing and stroke of the loopers.

Another object of the present invention is to provide a tufting machine in which the drive train for the looper shaft will allow for better synchronization between the drives on both ends of the machine.

Another object of the present invention is to provide a tufting machine in which the centrifugal and lateral forces generated by the drive train are minimized.

Another object of the present invention is to provide a tufting machine having a drive train which requires no counter-balancing weights to neutralize inertia and centrifugal forces generated by the drive train.

Another object of the present invention is to reduce to a minimum the horizontal and vertical vibrations of the tufting machine when it is in operation.

Another object of the present invention is to provide a tufting machine which is inexpensive to manufacture, efficient in operation and durable in structure.

Other objects, features and advantages of the present invention will become apparent from the following disclosure when considered in conjunction with the accompanying drawings, wherein like characters of reference designate corresponding parts throughout several views.

DETAILED DESCRIPTION

Figure 1:
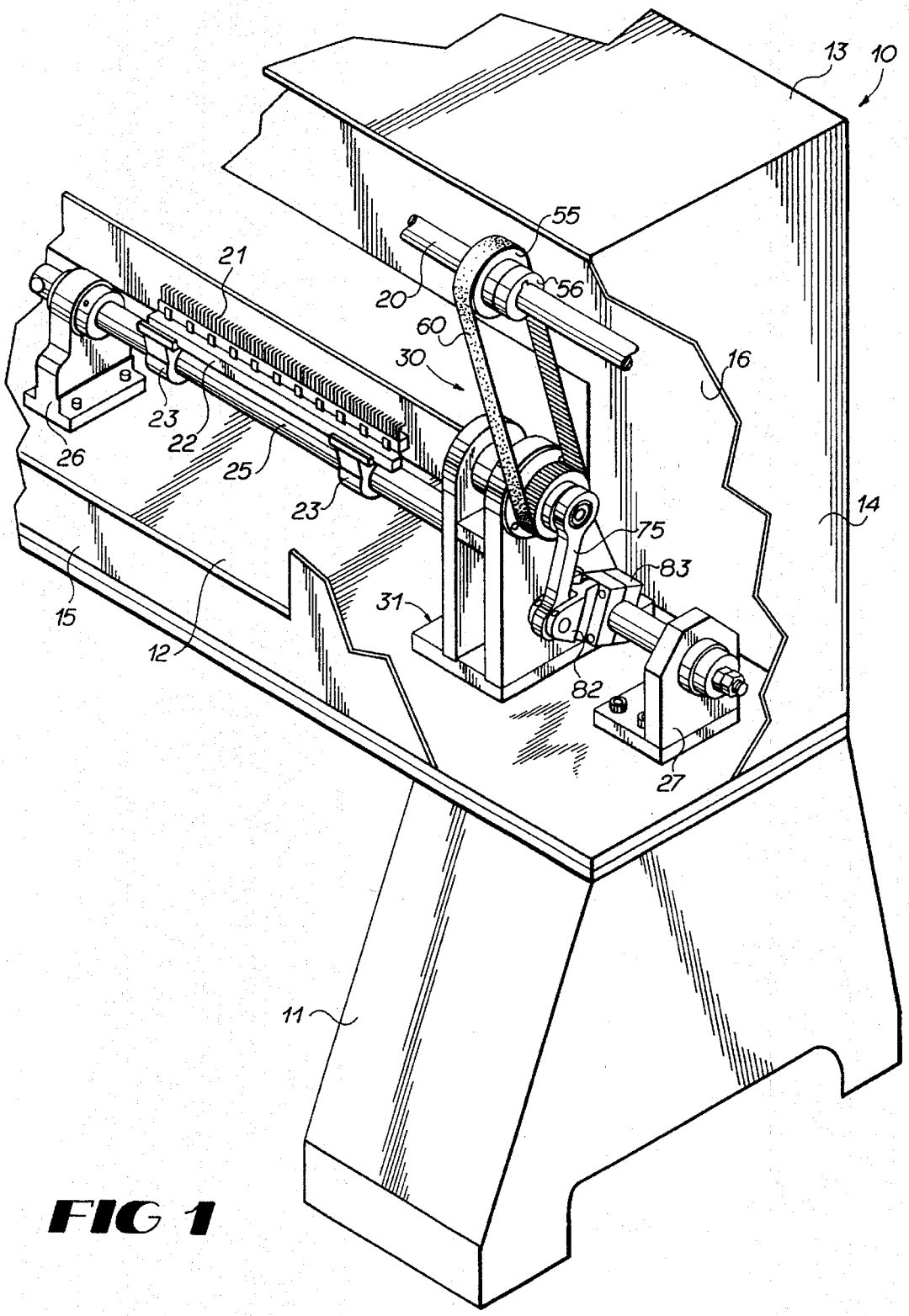
FIG. 1 is a fragmentary perspective view of a portion of a tufting machine having a drive train for the looper shaft, constructed in accordance with the present invention.

Referring now in detail to the embodiment chosen for the purpose of illustrating the preferred embodiment of the present invention, numeral 10 in FIG. 1 denotes, generally, the frame of a conventional tufting machine including legs, such as leg 11, which support a horizontally disposed base plate 12.

A main drive shaft 20 extends transversely throughout the width of the tufting machine, the main drive shaft 20 being driven by a motor or motors (not shown) so as to provide power for reciprocating the needle bars (not shown) for inserting the needles (not shown) through backing material (not shown) as the needles are reciprocated for inserting yarns into the backing material in a conventional way. Such yarns are caught by conventional loopers 21, the loopers 21 being reciprocated in timed relationship to the rotation of the shaft 20. The loopers 21, in turn, are supported by looper bars, such as looper bar 22, which are carried by brackets 23 on shaft 25 mounted on and rocked back and forth by a looper shaft 25 which extends adjacent to base plate 12 and parallel to and below main drive shaft 20.

The frame 10 also includes a top plate 13 and end plate 14, a front plate 15 and a rear plate 16. The looper shaft 25 is appropriately journaled by pillow blocks, such as pillow block 26, mounted on the base plate 12 and by end support blocks, such as end support block 27, so that the looper shaft 25 is free to rotate or rock back and forth for actuating the loopers 21.

Figure 2:
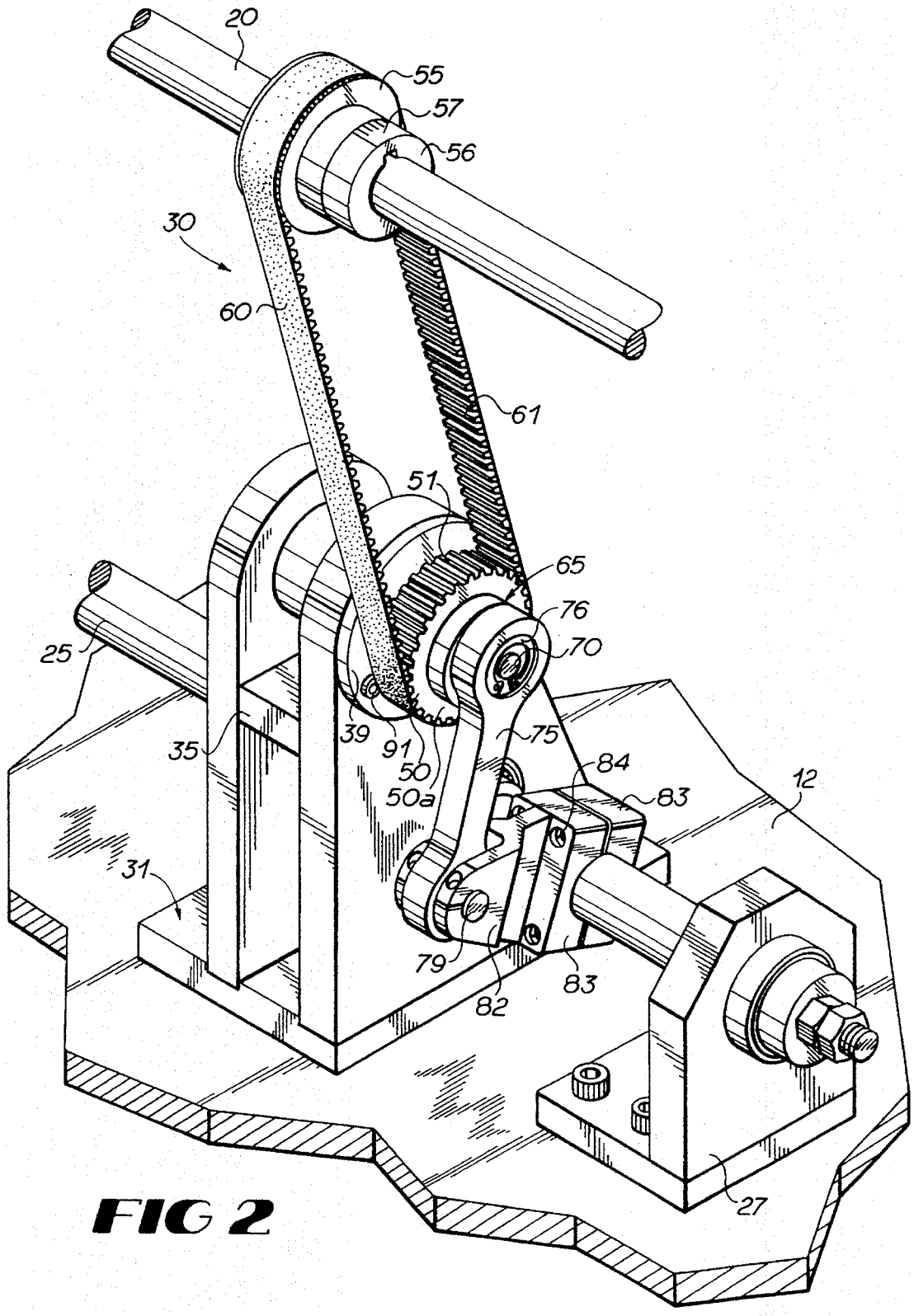
FIG. 2 is an enlarged fragmentary perspective view of a portion of the tufting machine depicted in FIG. 1.
Figure 3:
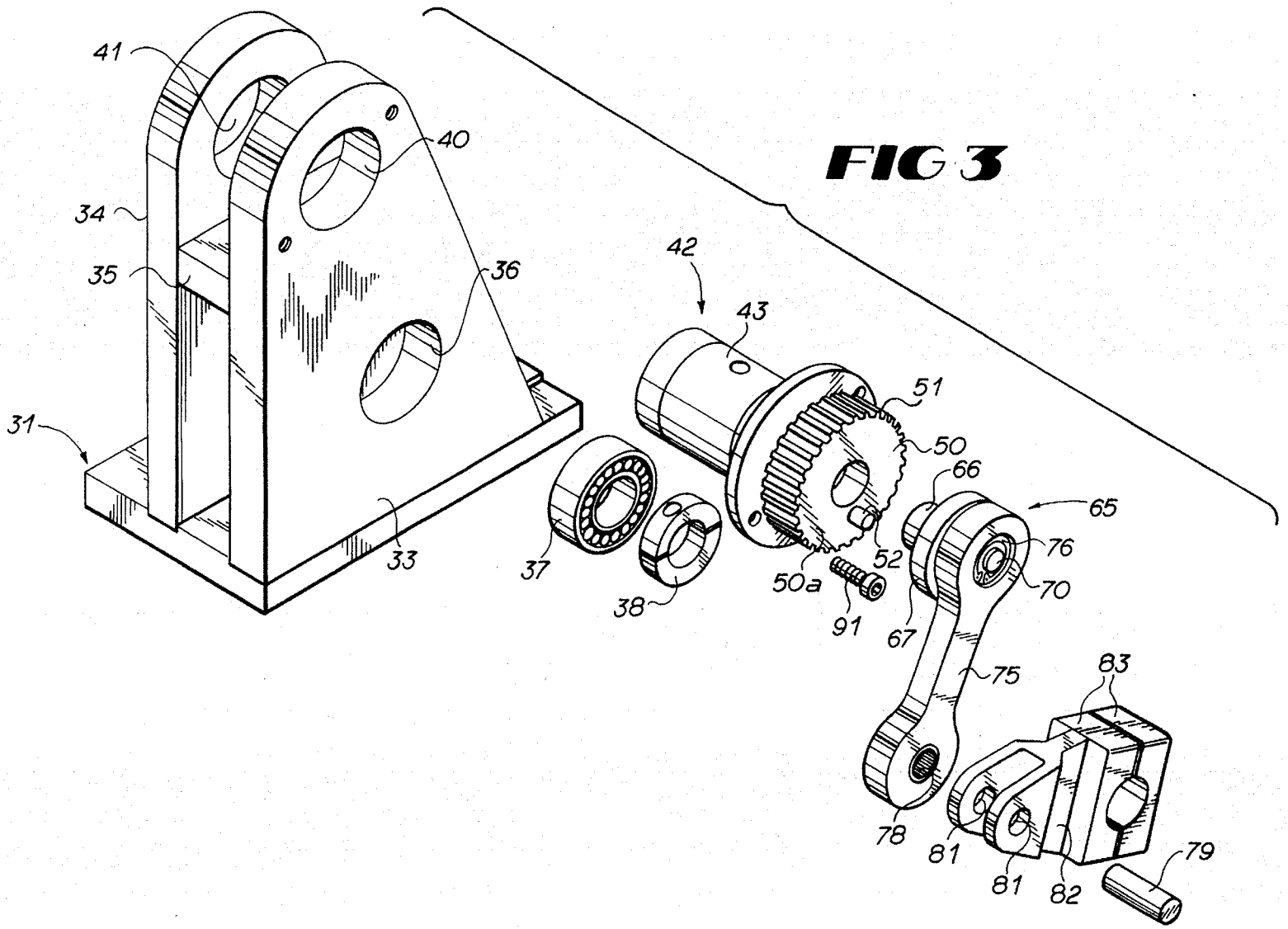
FIG. 3 is an enlarged exploded perspective view showing portions of the tufting machine depicted in FIG. 1.
Figure 4:
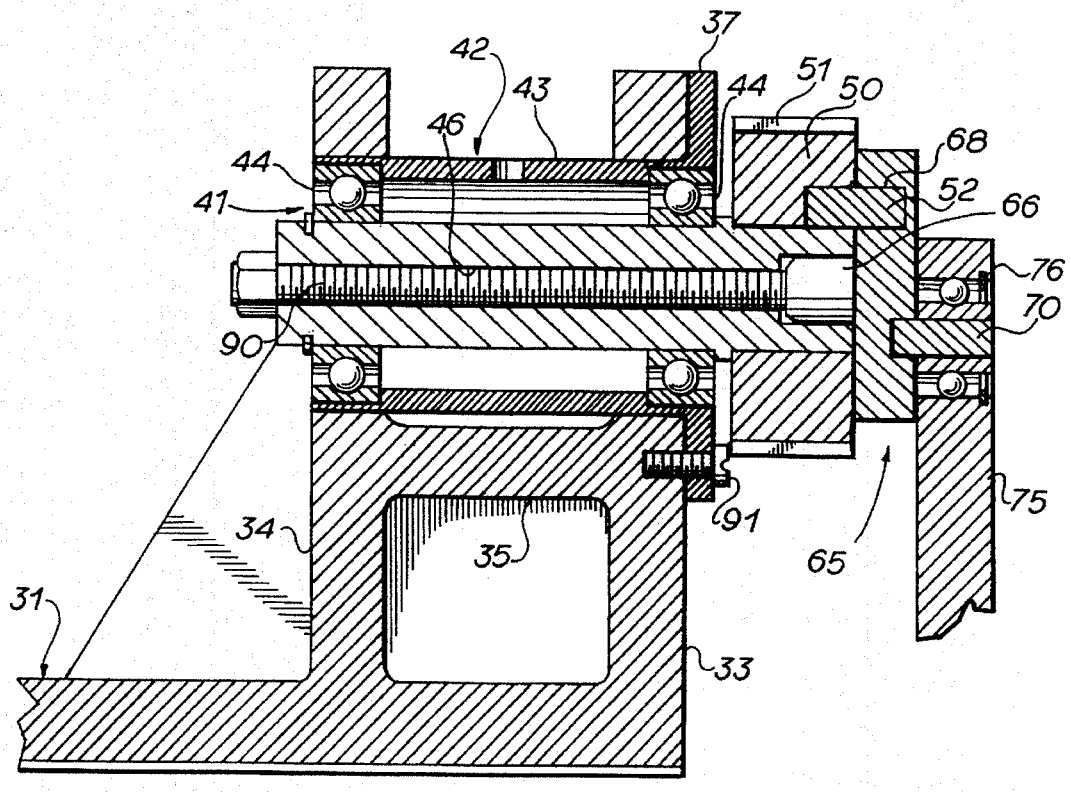
FIG. 4 is a vertical sectional view of a portion of the drive train of the tufting machine depicted in FIG. 1.
Figure 5:
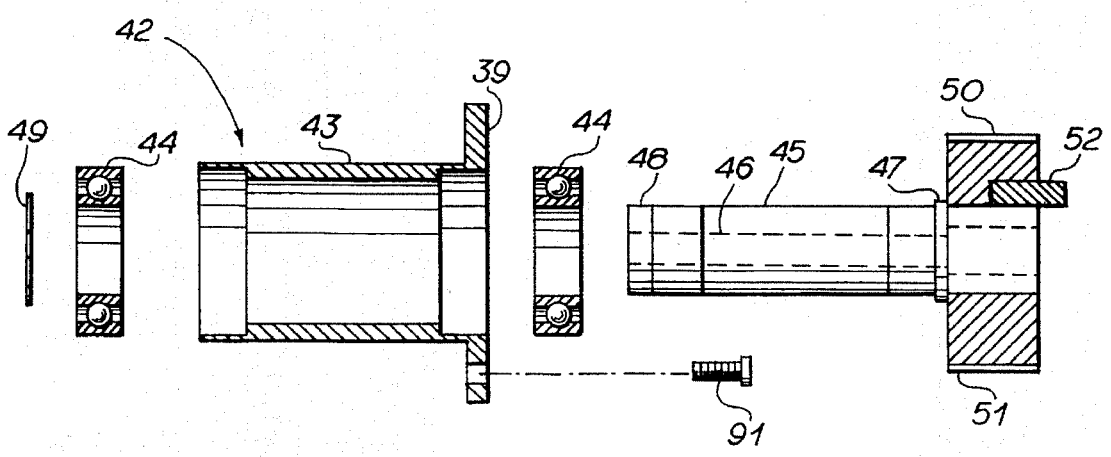
FIG. 5 is an exploded vertical sectional view of the spindle package of the drive train of the tufting machine shown in FIG. 1.

According to the present invention, the looper shaft 25 is rocked back and forth in timed relationship to the rotation of the main drive shaft 20 by a pair of complimentary drive trains, such as drive train 30, best seen in FIG. 2. The drive trains are mounted in the opposite end portions of the frame 10. Since each drive train, such as drive train 30, is identical and cooperates in driving opposite end portions of the looper shaft 25, only the drive train 30 at one end portion of the frame 10 is illustrated. This drive train 30 includes an upstanding pillow block denoted, generally, by the numeral 31. This pillow block 31 has a flat base 32 which mounts flat against the upper surface of base plate 12. Base 32 supports a pair of upstanding, longitudinally extending, opposed, complimentary, parallel brackets 33 and 34, the inner surfaces of which are spaced apart by a horizontal crossbar 35 which is parallel to and above base 32. The upstanding brackets 33 and 34 are provided with lower transversely aligned holes, such as hole 36, which receives roller bearings, such as roller bearing 37, press fitted therein. The looper shaft 25 passes through and is journaled by bearings 37 and is received by the end block 27, as illustrated in FIG. 1. Collars, such as collar 38, carried on the shaft 25, outwardly adjacent the bearings 37, prevents the inner races of the bearings from coming out of their holes and arrest appreciable axial movement of the shaft 25.

At their upper end portions, the upstanding brackets 33 and 34 are provided with transversely aligned second holes 40 and 41 which are adapted to receive the spindle package denoted, generally, by numeral 42. This spindle package 42 includes a tubular, cylindrical, bearing housing 43 which receives a pair of opposed, spaced, roller bearings or ball bearing 44 which, in turn, journal a stub shaft or spindle 45 which is disposed concentrically with and protrudes from both ends of the housing 43. One end of housing 43 has a butt flange or peripheral shoulder 39. When the pillow block 31 is appropriately mounted on base plate 12, the spindle 45 is disposed in parallel relationship to both the main drive shaft 20 and the looper shaft 25.

When the spindle package 42 is mounted in the aligned holes 40 and 41 of the upstanding brackets 33 and 34, the peripheral shoulder 39 is held in place by a pair of bolts, such as bolt 91 passing through shoulder 39 and into bracket 33.

Spindle 45 has a hollow counter-bored bore 46, axially through its length and is provided with a circumferential shoulder 47 inwardly adjacent its outer end. At its other or inner end portion, the spindle 45 is provided with a circumferential groove 48 for receiving the snap ring 49.

Press fitted on the end of the spindle 45 is a sprocket 50 which has peripheral teeth 51 and a radially disposed flat outer front face or surface 50a, an alignment pin 52 protrudes from its front face and has an axis parallel to the axis of the shaft or spindle 45. When the spindle package 42 is assembled, the shaft or spindle 45 is passed through the two aligned roller bearings 44 and is retained thereon by the shoulder 47 abutting one roller bearing 44 and the snap ring 49 abutting the other bearing 44. At its outer end, the spindle 45 is counter-bored to a larger diameter to form an outwardly opening socket.

The shaft 20 is provided with a freely rotatable sheave or wheel 55 having external teeth (not shown) along its periphery. Bolts or set screws (not shown) secure the sheave 55 in place on shaft 50 when it has been timed. Adjacent to the sheave 55, shaft 20 is provided with a keyway and is keyed to timing disc 56 having indicia 57 thereon. The purpose of this indicia 57 is to permit the positioning of sheave 55 in an appropriately timed relationship to the other sheave (not shown) at the other end portion of the tufting machine.

The sprocket or wheel 50 serves a double function of being driven by belt 60 in synchronization with the rotation of shaft 20 and of providing a flat radial outer surface for removably receiving and retaining for rotation therewith, the timing or stroke control lug 65 inserted axially onto the outer surface 50a of sprocket 50. The pin 52 and stub shaft 66 function as an alignment means which assures the appropriate positioning of the lug 65 against sprocket 50, to thereby automatically fix circumferentially and radially the position of the crank or pivot pin 70.

The wheel or sheave 55 is provided with circumferentially disposed external teeth (not shown) which mesh with the teeth 61 on the internal surface of the timing belt 60. This timing belt 60 forms a drive member which passes partially around the sheave 55 and thence partially around the wheel or sprocket 50 received on the end of spindle 45. Thus, the teeth 61 mesh with the teeth of sheave 55 and teeth 51 of sprocket 50. Hence, the sprocket 50 is rotated by belt 60 in timed synchronous relationship and at the same speed as the main drive shaft 20. Sprocket 50 functions as a receiving plate against which the stroke control lug 65 is mounted.

The function of this timing lug or stroke control lug 65 is to establish both the timing and the stroke or extent of rocking of the looper shaft 25 per revolution and, therefore, the timing and extent of the rocking of the loopers 21. Lug 65 has a disc-shaped body 67 having a central alignment finger or stub shaft 66 protruding from the inner face or surface of the body 67. Stub shaft 66 is concentric with the periphery of body 67 and concentric with sprocket 50. The finger or central stub shaft 66 is of a diameter to be snugly received in the counter-bored end portion or socket of the bore 46 of spindle 45. The timing lug 65 is also provided with a hole 68 parallel to and offset from the stub shaft 66 and through which the alignment pin 52 protrudes so as to align the lug 65 circumferentially with the sprocket 50.

Protruding outwardly from the outer face or surface of the body 67 of lug 65, is an axially extending orbital looper drive pin or crank pin 70, the axis of which is parallel to but offset from the axis of the sprocket shaft 5 and stub shaft 66. The distance between the axis of the crank pin 70 and the axis of spindle 45 will determine the extent of the stroke of the loopers 21. The position of the crank pin 70, circumferentially with respect to the pin 52, will determine the timing for the loopers 21. Thus, there can be provided a number of interchangeable connecting links or looper control lugs 65 in which the crank pin 70 is positioned in different locations radially and/or circumferentially prescribing different strokes and timings for the loopers 21.

Mounted for reciprocation by the orbital looper drive or crank pin 70 is a rigid looper drive strap or connecting link 75. This connecting link 75 carries at its upper end portion a roller bearing or ball bearing 76 through which the crank pin 70 protrudes. The lower end portion of the connecting link 75 is provided with a roller bearing or ball bearing 78 through which a removable linch pin 79 projects when the bearing 78 is aligned with opposed holes 81 of a clevis or bifurcated distal end of lever 82. This lever 82, in turn, is removably mounted by the clamping blocks 83 on its proximal end which clamp about the looper shaft 25. Bolts 84 removably secure the two clamping blocks 83 in clamping relationship on opposite sides of the shaft 25 so that lever 82 protrudes sidewise or radially from one end portion of shaft 25, at a position between the end support block 27 and pillow block 31.

A draw bolt 90 which passes from the open end of spindle 45 through the bore 46 of the spindle 45 is threadedly received in the end of stub shaft 66, securing the stroke control lug 65 in place. By removing shaft 66, the lug 65 can be replaced, from time to time, as is deemed necessary. The stroke control lug 65 is quite inexpensive to manufacture and can readily be replaced when the link or looper drive strap 75 and the bolt 90 are removed.

The belt driven looper drive train of the present invention, as described above, is about one-eighth of the mass of a conventional cam and strap assembly for the tufting machine. The bearings 76 and 78 are much smaller than the bearings necessary for the conventional cam and strap assembly and, therefore, can operate at much higher rates of speed than the bearings of the conventional cam and strap assembly. Furthermore, these bearings 76 and 78 carry a lighter load and there is less heat generated by them. Also, bearings 76, being spherical roller bearings, can carry both axial loads as well as radial loads.

In this belt driven drive train of the present invention, the parts are much easier to replace, in the event of failure, and the main drive shaft does not require disassembly for achieving most repairs. Indeed, in most instances, the draw bolt 90 and the linch pin 79 are the only parts which need be removed in order to permit the other replaceable parts to be removed and changed. In contrast, in a traditional looper drive system, it is necessary to remove the belts and pulleys which drive the main shaft from the motor, remove the end cover plates of the machine, the bearing pillow blocks, the drive cams and straps to simply replace a conventional drive train. Furthermore, the removal of the cam and strap assembly or assemblies often results in damage to the main shaft, thereby requiring replacement of the main shaft.

In the machine of the present invention, the looper stroke changes are made by simply changing the lug and connecting link assembly which includes both the timing lugs, such as lug 65 and an associated link, such as link 75, rather than attempting to adjust both straps by the same amount in the traditional tufting machine. The use of the identical lugs 65 and links 75 on both ends of the tufting machine, allows for immediate synchronization between the drives on both ends of the machine without the necessity of any timing adjustments relating to the main drive shaft 20. In a conventional looper drive train, the adjustments of the strap are infinite making it difficult to provide exactly the same effective length for straps on both ends of the tufting machine. Furthermore, increasing the length of the prior art straps results in acceleration and displacement differences in the motion of the opposite ends of the machine.

Preferably, the lugs 65 and links 75 of the various assemblies are so matched to each other that each lug and link assembly adds to or subtracts from the arc of travel for the loopers; however, all will prescribe the same retracted position as a starting reference for the loopers but will permit the loopers to travel to different prescribed forwardmost positions.

Due to the low mass of the looper drive train of the present invention, no compensation of counterweights are needed to neutralize the inertia or centrifugal forces generated by the drive train. In addition, the looper drive train has a low center of gravity, which is much lower than that of a conventional cam and strap system and reduces the horizontal vibrations of the tufting machine.

In the past, special slotted steel straps were needed on machines equipped with sliding needle bars so as to avoid interference with the needle bar shifting drive. This large heavy strap is eliminated by the present invention, due to the new location and compact nature of the belt looper drive train of the present invention.

It will be obvious to those skilled in the art that many variations may be made in the embodiment here chosen for the purpose of illustrating the present invention, without departing from the scope thereof as defined by the appended claims.

We claim:

1. A tufting machine having a frame, a transversely extending drive shaft in said frame, and a looper shaft in said frame and disposed in parallel relationship to said drive shaft; said looper shaft controlling a rocking of said loopers during a tufting operation of said machine, wherein an improvement comprises:

(a) a rotatable spindle journaled in a fixed position on said frame, between said drive shaft and said looper shaft and closer to said looper shaft than to said drive shaft;

(b) a drive member for transmitting power from said drive shaft to said spindle for rotating said spindle;

(c) a link carried by said spindle for being reciprocated in synchronization with a rotation of said drive shaft; and (d) a lever connected to said link and to said looper shaft for imparting a rocking motion to said looper shaft in synchronization with the reciprocation of said link.

2. The tufting machine defined in claim 1 wherein an axis of said spindle is parallel to axes of said drive shaft and said looper shaft.

3. The tufting machine defined in claim 1 wherein said drive member includes an endless belt passing partially around said drive shaft and partially around said spindle for rotating said spindle.

4. The tufting machine defined in claim 1 wherein said drive member includes a first wheel on said drive shaft, a second wheel on said spindle and an endless belt passing partially around said first wheel and partially around said second wheel.

5. The tufting machine defined in claim 1 wherein said drive member includes a sprocket on an end of said spindle for rotation thereon, a sheave on said drive shaft, an endless flexible belt passing partially around said sheave and partially around said sprocket for driving said sprocket in synchronization with the rotation of said drive shaft, a pivot pin carried in an orbital path by said sprocket when said sprocket is rotated, said pivot pin being connected to said link for imparting said reciprocation to said link.

6. The tufting machine defined in claim 1 further including a pivot pin carried at one end of said spindle for movement in an orbital path about an axis of said spindle upon rotation of said spindle, said pivot pin being received in one end portion of said link for imparting said reciprocation to said link.

7. The tufting machine defined in claim 1 further including a lug on one end of said spindle and connected to said link, and a pivot pin on said lug for being moved in an orbital path when said power is transmitted from said drive shaft to said spindle for imparting said reciprocation to said link.

8. The tufting machine defined in claim 7 further including a belt extending between said drive shaft and said spindle for driving said lug.

9. The tufting machine defined in claim 8 further including a wheel on the one end of said spindle, said wheel carrying said pivot pin through said lug and receiving said power from said drive shaft through said belt.

10. The tufting machine defined in claim 9 wherein said wheel on the one end of said spindle is a sprocket and said belt includes internal teeth for meshing with teeth of said sprocket.

11. The tufting machine defined in claim 1 including a wheel on an end of said spindle, a pivot pin parallel to said spindle for being carried by said wheel in an orbital path about an axis of said spindle, said pin being connected to one end of said link for imparting said rocking motion to said looper shaft.

12. The tufting machine defined in claim 11 wherein said wheel is provided with a radial face having a central opening and including a lug carrying said pin, said lug being removably received against said radial face for rotation with said wheel when said wheel is rotated.

13. The tufting machine defined in claim 1 including a stroke control lug between said spindle and said link for reciprocating said link upon rotation of said spindle.

14. The tufting machine defined in claim 13 including a receiving plate on an end of said spindle, said receiving plate having a radially extending outer face and wherein said lug is removably received on said outer face for rotation thereby, said lug having a pivot pin protruding axially therefrom for being received in an end of said link.

15. A tufting machine for carrying out a tufting operation in which successive tufts are sewn in a backing materials said machine having a frame, a transversely extending drive shaft in an upper portion of said frame and a looper shaft disposed in a lower portion of said frame parallel to said drive shaft for carrying loopers which engage said tufts, wherein an improvement includes a drive train comprising:

(a) a first wheel on said drive shaft;

(b) a second wheel carried for rotation about an axis parallel to said drive shaft and said looper shaft, said second wheel being closer to said looper shaft than to said drive shaft;

(c) an endless belt extending between said first wheel and said second wheel for driving said second wheel upon rotation of said first wheel;

(d) a crank pin carried by said second wheel, said crank pin being offset from said axis of said second wheel for movement in an orbital path about said axis upon rotation of said second wheel;

(e) a link connected to said crank pin for being reciprocated by said crank pin upon rotation of said second wheel; and (f) a lever protruding transversely from said looper shaft and having a distal end spaced from said looper shaft, said link being connected to said distal end of said lever for transferring a reciprocal motion of said link into a rocking motion of said looper shaft.

16. The tufting machine defined in claim 15 further including a spindle for supporting the rotation of said second wheel, said second wheel being located below said drive shaft and above said looper shaft.

17. The tufting machine defined in claim 16 including a pillow block supporting said spindle for rotation with said second wheel about said axis of said second wheel.

18. The tufting machine defined in claim 17 in which said second wheel is supported for rotation on an end of said spindle and said crank pin is moved in a radial plane of said axis.

19. The tufting machine defined in claim 15 including a stroke control lug removably mounted on a side of said second wheel and said crank pin protrudes from said stroke control lug.

20. The tufting machine defined in claim 19 including an alignment member between said second wheel and said lug for positioning said lug on said second wheel.

21. Process of tufting in which a drive shaft is rotated for producing a tufting operation in a tufting machine wherein loops of yarn are inserted through a backing material and a looper shaft imparts reciprocation to loopers which catch and temporarily hold the loops of yarn after said loops of yarns have been formed, wherein an improvement comprises:

(a) moving a pin in an orbital path about an axis in a timed relationship to a formation of said loops;

locating said pin closer to said looper shaft than to said drive shaft;

(b) translating an orbital movement of said pin into a reciprocating movement; and (c) imparting said reciprocating motion to said looper shaft for rocking said loopers in synchronization with a rotation of said drive shaft.

22. The process defined in claim 21 including the step of translating the orbital movement of said pin into the reciprocating movement of a link and imparting said reciprocating movement of said link to a lever on said looper shaft for imparting a rocking motion to said looper shaft.

23. A tufting machine having a frame, a transversely extending drive shaft in said frame, and a looper shaft in said frame and disposed in parallel relationship to said drive shaft, said looper shaft controlling a rocking of loopers during a tufting operation of said machine, wherein an improvement comprises:

(a) a rotatable member in said frame, between said drive shaft and said looper shaft and closer to said looper shaft than to said drive shaft, for rotation about an axis;

(b) a drive member for transmitting power from said drive shaft to said rotatable member for rotating said rotatable member;

(c) a lug carried at one end of said rotatable member for rotation therewith;

(d) a pivot pin protruding from said lug offset from said axis for movement in an orbital path about said axis upon rotation of said rotatable member;

(e) a link, carried by said pivot pin, for being reciprocated in synchronization with a rotation of said drive shaft; and (f) a lever connected to said link and to said looper shaft for imparting rocking motion to said looper shaft in synchronization with a reciprocation of said link.

24. The tufting machine defined in claim 22 wherein said lug and said link are replaceable by another lug and link for varying a stroke of said looper shaft.

* * * * *